US005853262A

United States Patent [19]

Vogel

[11] Patent Number: 5,853,262

[45] Date of Patent: Dec. 29, 1998

[54] PROCESS AND APPARATUS FOR DE-ICING ROADWAYS AND RE-USING COLLECTED MELTING SOLUTION

[75] Inventor: Elfriede Vogel, Buch am Erlbach, Germany

[73] Assignee: BTS Beratung und Technik fuer die Strasse GmbH, Buch am Erlbach, Germany

[21] Appl. No.: 727,576

[22] PCT Filed: Apr. 24, 1995

[86] PCT No.: PCT/EP95/01534

§ 371 Date: Oct. 23, 1996

§ 102(e) Date: Oct. 23, 1996

[87] PCT Pub. No.: WO95/29296

PCT Pub. Date: Nov. 2, 1995

[30] Foreign Application Priority Data

Apr. 26, 1994 [DE] Germany ..... 44 14 520.9

[51] Int. Cl.[6] ..... E01C 11/24

[52] U.S. Cl. ..... 404/71; 404/72; 244/134 R

[58] Field of Search ..... 404/2, 71, 72; 244/134 R, 134 C

[56] References Cited

U.S. PATENT DOCUMENTS

| | | | |
|---|---|---|---|
| 4,392,959 | 7/1983 | Coillet | 210/638 |
| 5,104,068 | 4/1992 | Krilla et al. | 244/134 R |
| 5,350,533 | 9/1994 | Hubred et al. | 252/70 |
| 5,462,655 | 10/1995 | Ladd et al. | 210/167 |
| 5,472,291 | 12/1995 | Vogel | 404/72 |
| 5,515,623 | 5/1996 | Weeks | 37/227 |

*Primary Examiner*—James A. Lisehora
*Attorney, Agent, or Firm*—Peter E. Rosden

[57] ABSTRACT

A process and an apparatus installation for de-icing roadways (1) automatically, to which is applied a melting-agent solution in water to lower the freezing point. The run-off from the roadways may be mixed with precipitation water and melted snow and ice as melt water. The latter is collected and, after having tested its melting-agent content (in 18), at least a portion of the melting-agent contained in the run-off leaving the roadway surface is re-used by re-applying it as an aqueous melting solution (via 11)—if necessary after adding fresh melting-agent—and, in particular, helps save melting-agent and is also less damaging to the environment by increasing (in 26) the solution's concentration in the melt water to be re-used before re-applying it as a melting solution in one separation step in the course of which water (in 31) free of or low in melting-agent on the one hand and a more highly concentrated solution (in 32) on the other hand are created as partial flows, as a consequence of which a larger percentage of the melt water can be re-used. This cycle can also integrate polluant-elimination steps.

9 Claims, 1 Drawing Sheet

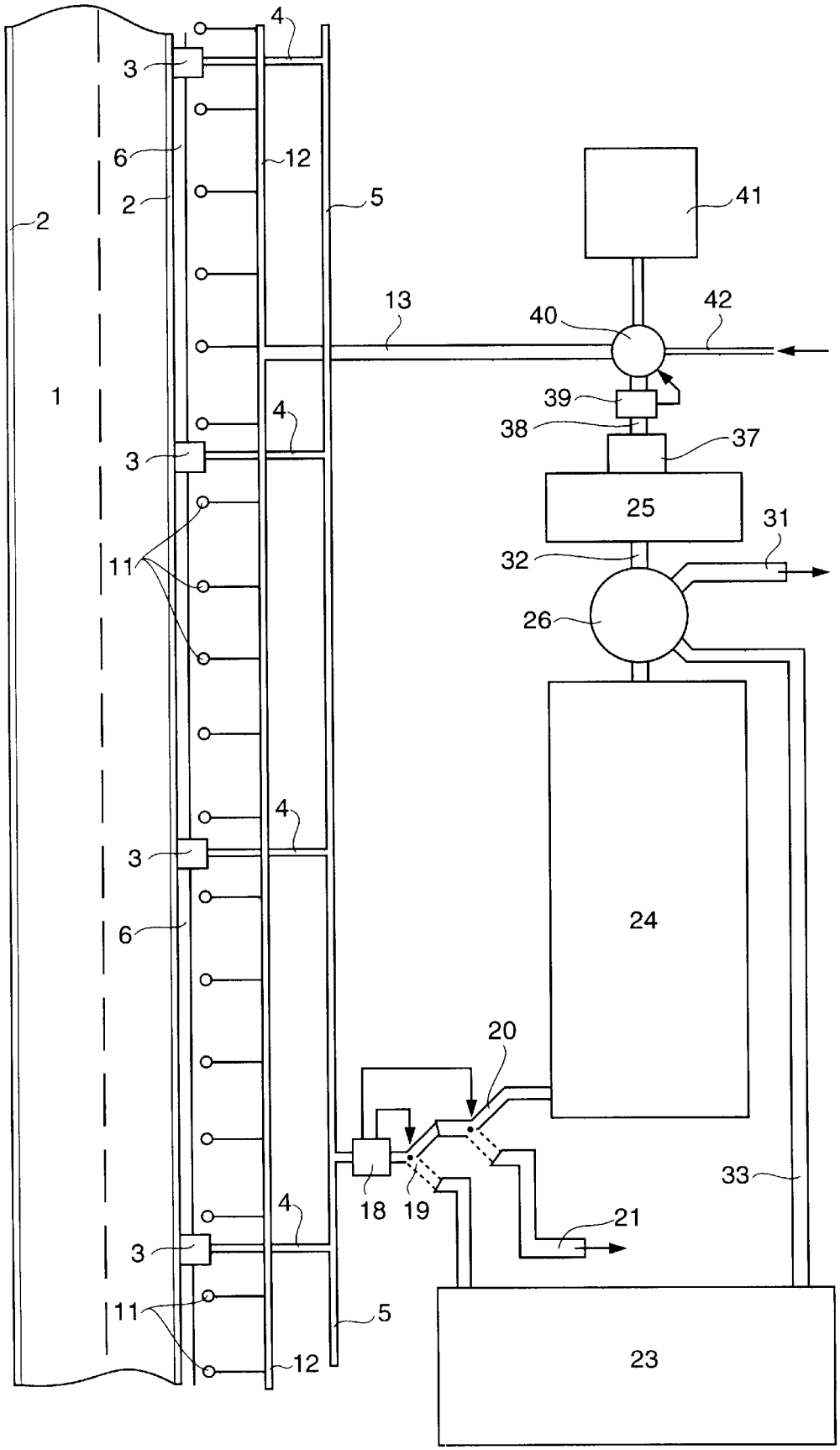
4
3
6
12
2
5
41
2
13
40
42
1
39
4
38
37
3
25
31
11
32
26
4
3
24
6
20
33
18
19
4
21
3
11
5
12
23

PROCESS AND APPARATUS FOR DE-ICING ROADWAYS AND RE-USING COLLECTED MELTING SOLUTION

FIELD OF THE INVENTION

The present invention relates to a process for de-icing roadways to which is applied a melting-agent solution in water to lower the freezing point, which solution, mixed with precipitation water and melted snow and ice, as melt water which is collected, runs off the roadway, is purified, if necessary, and, after its melting-agent content has been tested, at least partially is re-used by re-applying it to the roadway as the aqueous melting solution, if necessary after adding fresh melting-agent, and further relates to an apparatus installation for implementing the process, with facilities for applying the melting solution to the roadway along the roadways to be de-iced and with extracting devices for the collection of melt water running off the roadway, said extracting devices being connected, via channels, a concentration sensor for melting-agent concentration and a switch controlled by the sensor, on the one hand, to a drainage and on the other hand, to a collector tank which, in turn, is connected to the facilities for applying the melting-agent.

DESCRIPTION OF THE PRIOR ART

Such apparatus installation and process are known from publication No. WO 93/00481. According to this reference, the melt water running off roadways, in particular off expressways, is collected and, after adding more melting-agent or a highly concentrated melting solution if necessary, is re-applied to the roadway, in particular sprayed automatically onto the road surface via spray nozzles. Pure rainwater running off the roadway can also be diverted directly to a drainage receptacle. The re-use of the melt water for a new melting solution helps save melting-agent and is also less damaging to the environment, which is otherwise put under strain by the melting-agent content of the melt water, salt in particular. On the other hand, it has been proven that a particularly large quantity of melting-agent has to be added for the implementation of the known process in order to reach the required melting-agent concentration for de-icing purposes. If salt is used for de-icing purposes, a melting-agent consisting of an 25% solutions are used preferably. The melt water has, in the meantime, been rather diluted by added precipitation water and melted snow and ice, so that a major percentage thereof even has to be diverted directly to the drainage receptacle as it is not worth re-using.

SUMMARY OF THE INVENTION

The present invention, in contrast, is to ensure improved evaluation of the re-usable melting-agent. This is achieved by increasing the concentration of the solution in the melt water to be re-used before re-applying it as melting solution by subjecting it to a separation step in the course of which water free of or low in melting-agent content on the one hand and a more highly concentrated solution on the other hand are created as partial flows, preferably by means of an apparatus installation wherein a concentration increase stage is inserted between the collector tank and the facilities for applying the melting-agent, for concentrating the melting-agent in the melt water to be re-used as melting solution and with a drainage for the flow of reduced-concentration melt water. By means of these measures, a higher percentage of melt water can be re-used in the cycle.

Separation steps to increase the concentration and corresponding devices, mostly for the purpose of desalting (e.g. Schwering "Wasser wird wieder Wasser" (water becomes water again), a corporate publication of the Gütling GmbH), are known per se.

The known ion exchanger cycle systems, desalting systems and filtering installations with membrane filtration and ultra-filtration are suitable for this purpose. In the case of interposing mechanical filters filtering out dirt and floating particles from the melt water, systems operating according to the principle of osmosis are pre-eminently suitable for desalting steps. By means of these known devices, it is easy to separate a solution with a considerable melting-agent concentration from water almost free of salt; the solution whose melting-agent concentration was increased must either not at all or to a minor extent be increased by further additions.

Conventional desalting systems can extract 90% to almost 100% of the melting-agent contained in melt water. The degree of desalting and the costs involved can be chosen taking climatic conditions decisive for the frequency and quantity of the application of melting solution to roadways as well as purity requirements of run-off released into the environment into account.

The process according to the invention is particularly well-suited for application to a roadway top layer which consists of drain asphalt due to the fact that only a small quantity of melt water and slush is diffused to the environment in the case of such road surfaces but instead water is absorbed in the roadway due to the asphalt's porosity and melt water is collected further down.

The process according to the invention can be combined very favorably with a test of the melt water's pollutant impact, of oil in particular, and a drainage pipe for melt water particularly heavily polluted or a drainage pipe for pollutants for example into an oil separator or a filter such as a micro filter, which is more efficient with respect to separation. Micro filters have larger pores than ultra-filters. The pores, however, are nevertheless small enough to hold back oil. In addition, normal rainwater or run-off leaving the roadway can be subjected to a pollutant impact test and, possibly, to a corresponding subsequent treatment or a separation process.

BRIEF DESCRIPTION OF THE DRAWING

Further details, advantages and developments of the invention are shown in the following description of a preferred embodiment with reference to the drawing. The only figure shows a top view of a roadway with a device along the length of the roadway for the automatic de-icing process.

DESCRIPTION OF THE PREFERRED EMBODIMENT

The drawing shows a roadway 1 with verges 2 and drains 3 shown along the length of one of the verges, which are connected to a joint drainage channel 5 via run-off channels 4. This installation is marked along the length of one of the verges, it can also be installed on two sides or, in the case of roadways with a median strip, it can be implemented three-fold. On the surface between drains 3 and directed to them there are collecting pipes 6. These installations are required for the extraction of melt water as well as rainwater.

Further, there are facilities for the application of melting solution along the length of the roadway, that is spray nozzles 11 fed via distribution line 12, which, in turn, is supplied with melting solution, generally salt solution under pressure, via a line 13.

The melt water collected in drains 3, containing not only the melting solution sprayed onto the road surface but also melted snow and ice and precipitation water, partially is re-used as melting solution after a corresponding re-using process. For this purpose it initially passes through sensor 18, which, in the depicted embodiment, is at the same time a sensor for the pollutant impact of melt water, e.g. for oil, as well as for the melting-agent concentration, and controls two switches 19 and 20; switch 19 is switched on first and is a pollutant switch; switch 20, a solution switch, is connected to one outlet of switch 19. The first outlet of pollutant switch 19 leads to pollutant collector tank 23, which collects water heavily polluted with oil or chemicals spread on the roadway, for example as a consequence of an accident, for the purpose of disposal.

Unpolluted or negligibly polluted melt water is led to switch 20, which is controlled by sensor 18, dependent on the melting-agent concentration, in such a manner that the melt water flowing through is either diverted to drainage receptacle 21 if the melting-agent concentration is lower than for example 0.05% or to a melt water collector basin or tank 24 if the melting-agent concentration exceeds this mark. In the aforementioned application, the melt water collector tank 24 is in turn connected to a tank, meaning a solution collector basin or tank 25 at the outlet side, via a concentration increase stage 26. Tank 25 is considerably smaller than tank 24 and is covered in order to protect it against the penetration of precipitation water; it could also be a vessel. In average winter weather conditions prevailing in Central Europe 70% of the melt water collected in drains 3 can be expected to be diverted to the drainage receptacle via switch 20 and 30% to reach melt water collect or tank 24, approximately 15 to 20% of which, that is 5% of the original melt water quantity, can be expected to reach solution collector tank 25 after passing through concentration increase step 26. The melt water collector tank 24 thus has a capacity of approximately 30% of the water quantity statistically calculated for the corresponding region and for the relevant road surface during winter, that is from November until February, while solution collector tank 25 has a capacity of approximately 1 to 5% of this water quantity. If fast-operating desalting systems are applied in the concentration increase stage 26 enabling a high rate of flow and desalting, the capacity of melt water collector tank 24 and of solution collector tank 25 can also be desired for lower quantities due to the fact that only smaller quantities of fluid must be stored temporarily.

The percentages indicated are only to be considered as examples for orientation purposes as they can be subject to major fluctuations. The relative quantity of melt water to be processed, on the one hand, depends on climatic conditions, that is in particular on the quantity and frequency of melting-solution application, which is determined according to temperatures prevailing and precipitation quantities. On the other hand, the requirements with respect to the quality of the water to be diverted, which depend on the corresponding environmental requirements, are decisive factors for the degree of desalting and the run-off's permissible percentage of residual pollutant.

Concentration increase stage 26 consists of a commercial desalting system which releases fully or largely desalted water via a drainage pipe 31 into the drainage receptacle and, in the case of conventional water desalting, a concentrated melting-agent solution as the residual substance, in the present case the utility product, is led into solution collector tank 25 via a line 32. In the depicted embodiment, concentration increase stage 26 also includes a micro filter connected prior to the actual desalting step, which filters out oil and grease and supplies them via a line 33 to collector tank 23. Smaller pollutant quantities contained therein, which do not result in a complete switching of the pollutant switch 19, are filtered out at this point.

Melting solution, initially with a superficially regulated melting-agent concentration, is extracted from solution collector tank 25 if an adequate quantity is collected therein, and is passed through a suction pump 37 via supply line 38 and is passed through a further sensor 39 controlling mixing valve 40 which supplies the melt water, as required, with fresh melting-agent or a highly concentrated melting-agent solution, from supply tank 41, or is mixed with diluting water from a water pipe 42. It may become necessary to mix water into the solution if the melting-agent concentration of the melting solution is regulated temperature-dependently and if concentration increase stage 26 supplies a melting-agent concentration for the coldest weather conditions to be expected.

In an application not depicted herein, the desired melting solution concentration is regulated directly in the solution collector tank 25 by feeding it with a highly-concentrated solution from the concentration increase stage 26 on the one hand and, on the other hand, by supplying the solution collector tank 25, as required, with a certain quantity of low-concentration melting solution from the melt water collector tank 24 via a further line.

It is possible to subdivide the tank further; in sensitive areas such as protected-water areas for example, water supplied via switch 20 and concentration increase stage 26 can again be diverted to an intermediate tank. A multi-step concentration increase, whereby melt water running off the roadway with a relatively high concentration of melting-agent is led directly to a tank with a higher degree of concentration, can also be carried out. The following would be possible: melt water with a salt content of less than 0.1% to be added to run-off water, melt water with a salt content of 0.1% to 1% to be led into a first melt water collector tank with a low degree of concentration and melt water with a salt content of more than 1% when running off the roadway to be passed at once to a second step of the melt water collector tank. The concentration step can itself be subdivided into a cascade of smaller steps.

In a further application not depicted herein, the melt water running off the roadway is, on principle, first to be led into pollutant collector tank 23. Subsequently, it is led through a purification unit filtering out pollutant substances and dirt particles. It is only then that the pretreated water, dependent on the melting-agent concentration, is led either into melt water collector tank 24 or into drainage receptacle 21. This guarantees that no malfunction of the desalting system is caused by dirt particles or pollutant substances.

Finally, it is also possible to pump the melting solution available into winter-service tanker vehicles and to thus spray the melting solution onto roadway sections according to need if no installation for spray nozzles 11 is at hand or if solution collector tank 25 is full and if there is currently no adequate need for immediate local de-icing.

I claim:

1. A process for de-icing roadway surfaces onto which pollutants such as oil and chemicals may have been deposited comprising the steps of:

applying to the roadway surface a solution of melting agent mixed with water in an amount sufficient to lower the freezing point of water so that a run-off mixture containing water, pollutants and at least some of the melting agent is produced;

collecting at least part of the resulting run-off mixture;

testing the collected run-off mixture to determine the concentration of melting agents and pollutants therein;

separating the run-off mixture into a first more heavily polluted portion and a second relatively unpolluted portion;

diverting the first more heavily polluted portion into a pollutant collector tank;

separating the second relatively unpolluted portion into a third portion having a low melting agent concentration and into a fourth portion having a higher melting agent concentration;

diverting the third portion into a drainage receptacle;

diverting the fourth portion into a melt water collector tank;

filtering the fourth portion by means of a micro filter to further reduce the amount of pollutants remaining in the fourth portion;

increasing the concentration of melting agent in the fourth portion to produce a concentrated fourth portion including removing water having little pollutants or melting solution therein from the melt water collector tank by releasing it into the drainage receptacle;

mixing additional melting agent and additional water, as required, with the concentrated fourth portion to produce a solution of melting agent having a desired concentration level of melting agent; and dispersing the solution resulting from said mixing step on the roadway surface thereby re-using at least some of the melting agent first applied to the roadway surface during said applying step.

2. The process of claim 1, wherein said mixing step is preceded by the step of testing the concentrated fourth portion to determine if the amount of melting agent in the concentrated fourth portion is at a desirable level.

3. The process of claim 2, wherein said increasing step further includes the step of adding either pure or slightly diluted melting agent to the concentrated fourth portion from a tank containing pure melting agent.

4. The process of claim 3, wherein the third portion has a melting agent concentration of less than 0.05 percent and the fourth portion has a melting agent concentration of 0.05 percent or more.

5. The process of claim 1, wherein the dispersing step includes the additional steps of:

filling tanker vehicles having application devices with the solution;

transporting the solution to the roadway surface by means of the tanker vehicles; and applying the solution to the roadway surface through the application devices included on the tanker vehicles.

6. The process of claim 5, wherein the filling step includes the additional step of independently adding melting agent to the tanker vehicles together with the solution.

7. The process of claim 1, wherein the mixing step includes the additional step of mixing part of the fourth portion from the melt water collector tank with the concentrated fourth portion.

8. A process for de-icing roadway surfaces onto which pollutants such as oil and chemicals may have been deposited comprising the steps of:

applying to the roadway surface a solution of melting agent mixed with water in an amount sufficient to lower the freezing point of water so that a run-off mixture containing water, pollutants and at least some of the melting agent is produced;

collecting at least part of the resulting run-off mixture;

testing the collected run-off mixture to determine the concentration of melting agent and of pollutants therein;

separating the run-off mixture into a first more heavily polluted portion and a second relatively unpolluted portion;

diverting the first more heavily polluted portion into a pollutant collector tank;

separating the second relatively unpolluted portion into a third portion having a low melting agent concentration and into a fourth portion having a higher melting agent concentration;

diverting the third portion into a drainage receptacle;

diverting the fourth portion into a melt water collector tank;

increasing the concentration of melting agent in the fourth portion through ion exchange to produce a concentrated fourth portion;

mixing additional melting agent and additional water, as required, with the concentrated fourth portion to produce a solution of melting agent having a desired concentration level of melting agent; and dispersing the solution resulting from said mixing step on the roadway surface thereby re-using at least some of the melting agent first applied to the roadway surface during said applying step.

9. A process for de-icing roadway surfaces onto which pollutants such as oil and chemicals may have been deposited comprising the steps of:

applying to the roadway surface a solution of melting agent mixed with water in an amount sufficient to lower the freezing point of water so that a run-off mixture containing water, pollutants and at least some of the melting agent is produced;

collecting at least part of the resulting run-off mixture;

testing the collected run-off mixture to determine the concentration of melting agent and of pollutants therein;

separating the run-off mixture into a first more heavily polluted portion and a second relatively unpolluted portion;

diverting the first more heavily polluted portion into a pollutant collector tank;

separating the second relatively unpolluted portion into a third portion having a low melting agent concentration and into a fourth portion having a higher melting agent concentration;

diverting the third portion into a drainage receptacle;

diverting the fourth portion into a melt water collector tank;

increasing the concentration of melting agent in the fourth portion through filtration to produce a concentrated fourth portion;

mixing additional melting agent and additional water, as required, with the concentrated fourth portion to produce a solution of melting agent having a desired concentration level of melting agent; and dispersing the solution resulting from said mixing step on the roadway surface thereby re-using at least some of the melting agent first applied to the roadway surface during said applying step.

* * * * *